US005078374A

United States Patent [19]

Odeau

[11] Patent Number: 5,078,374

[45] Date of Patent: Jan. 7, 1992

[54] MACHINE FOR CUTTING AND FOLDING A PRINTED PAPER STRIP

[75] Inventor: Michel Odeau, Creil, France

[73] Assignee: Harris-Marinoni S.A., Montataire, France

[21] Appl. No.: 479,963

[22] Filed: Feb. 14, 1990

[30] Foreign Application Priority Data

Feb. 28, 1989 [FR] France ..... 89 02589

[51] Int. Cl.[5] ..... B42C 1/00

[52] U.S. Cl. ..... 270/49; 270/50; 270/6; 270/42; 493/432

[58] Field of Search ..... 270/6, 21.1, 41, 42, 270/45, 46, 47, 48, 49, 50, 60; 493/424–429, 431–432

[56] References Cited

U.S. PATENT DOCUMENTS

| | | | |
|---|---|---|---|
| 2,019,658 | 11/1935 | Crafts | 270/50 |
| 2,164,370 | 7/1939 | Zuckerman | 270/47 |
| 2,985,449 | 5/1961 | Dietrich | 270/50 |
| 4,190,242 | 2/1980 | Bolza-Schunemann | 270/50 |
| 4,368,879 | 1/1983 | Hoshi | 270/42 |
| 4,739,704 | 4/1988 | Kitai . | |

FOREIGN PATENT DOCUMENTS

| | | |
|---|---|---|
| 0222151 | 3/1988 | European Pat. Off. . |
| 2837271 | 4/1979 | Fed. Rep. of Germany . |
| 2322078 | 3/1977 | France . |

*Primary Examiner*—Edward K. Look
*Assistant Examiner*—Therese M. Newholm
*Attorney, Agent, or Firm*—Tarolli, Sundheim & Covell

[57] ABSTRACT

In the machine, a tabloid brochure produced from the strip is either stripped directly from a folding cylinder (30) or passed between the folding cylinder and a second fold cylinder at which a transverse, so-called second fold is made.

The folding cylinder (30) comprises at least one insertion blade (37A, 37B) movable between two fixed positions, a deployed position in which it projects relative to the lateral surface of the cylinder and is adapted to cooperate with a jaw of the second fold cylinder, and a retracted position in which it is inside the folding cylinder, the insertion blade being adapted to be deployed when it is necessary to make said second fold and retracted otherwise.

28 Claims, 4 Drawing Sheets

MACHINE FOR CUTTING AND FOLDING A PRINTED PAPER STRIP

This invention concerns a machine for cutting and folding a printed paper strip, in particular for use on the downstream side of a rotary printing machine.

There is already known a machine of this kind as shown in FIGS. 1 through 3 together with the brochures that it produces:

Figure 2:
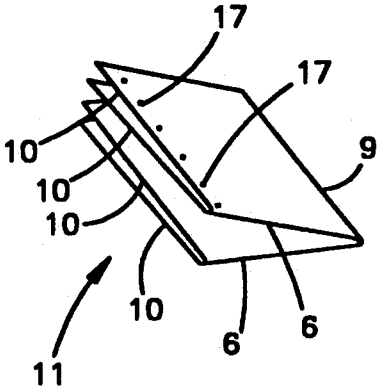
FIG.2 (PRIOR ART)
FIG. 2 shows in perspective a tabloid brochure, that is to say a brochure obtained directly at the output from the folding cylinder.

The machine comprises a triangle 1, a cutting cylinder 2, a transfer cylinder 3, a folding cylinder 4 and a second fold cylinder 5.

Figure 3:
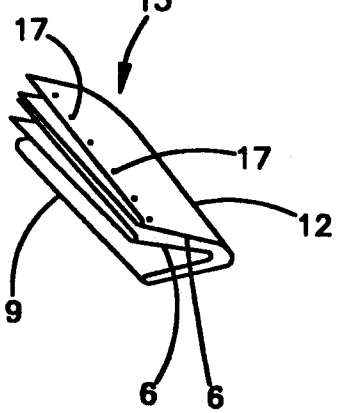
FIG.3 (PRIOR ART)
FIG. 3 shows in perspective a brochure obtained at the outlet from the second fold cylinder.

A printed strip first enters the triangle 1 which forms midway between its edges a longitudinal fold 6 (see FIGS. 2 and 3), usually called the triangle fold, after which the folded strip 7 passes between the cutting cylinder 2 and the transfer cylinder 3 at which a transverse cut separates one copy 8 from the folded strip 7, the copy 8 then passing between the transfer cylinder 3 and the folding cylinder 4 at which a transverse fold 9, generally called the first fold, is made midway between the cuts 10 which delimit the copy 8, which at the end of this folding operation constitutes a tabloid brochure 11 as shown in FIG. 2 which is either stripped directly from the folding cylinder 4—or as in the configuration shown—passed between the folding cylinder 4 and the second fold cylinder 5 at which a transverse fold 12, generally called the second fold, is made midway between the transverse cuts 10 (which are now adjacent) and the first fold 9, producing a brochure 13 like that shown in FIG. 3.

The circumference of the cutting cylinder 2 is equal to the printing length on the paper (it has the same diameter as the printing machine print roller(s)) and the cylinder is provided along one generatrix (that is to say, a line on its lateral surface parallel to its rotation axis) with a saw 14 which cooperates successively with one of the grooves 15A or 15B in the transfer cylinder 3 to cut the folded strip 7.

The diameter of the transfer cylinder 3 is twice that of the cylinder 2 so that a copy 8 covers it over half its circumference. Near and downstream of each groove 15A or 15B it comprises a row of needles 16A or 16B, generally called dowels, which are deployed or retracted relative to the surface of the cylinder 3 to respectively secure to the cylinder the strip 7 or the copy 8—by passing through them (which leaves traces 17 visible in FIGS. 2 and 3)—or release them, as necessary.

Midway between the dowels 16A and 16B the transfer cylinder 3 comprises an insertion blade 18A or 18B which inserts the portion of the copy 8 which overlaps it in the jaw 19A or 19B of the folding cylinder 4, which forms the first fold 9.

In the configuration shown the folding cylinder 4 also comprises two insertion blades 20A and 20B similar to those of the cylinder 3 and which respectively insert the portion of the tabloid brochure 11 which overlaps them in the jaw 21A or 21B of the second fold cylinder 5 to form the second fold 12; the resulting brochure 13 is removed from the cylinder 5 by the stripper 22 which directs it to the conveyor 23 on which it continues its progress through the machine.

To change from the configuration as shown to one in which the tabloid brochure is stripped directly from the cylinder 4 by the stripper 24 which directs it to the conveyor 25 it is necessary to carry out a number of operations and in particular to declutch the cylinder 5, change the position of the stripper 24 from the out-of-service position shown to its in-service position, operate on the mechanism controlling the jaws 19A and 19B to cause them to open near the stripper 24 and not from the point at which they are located when the blades 24A and 24B are in the jaws 21A and 21B, demount the insertion blades 20A and 20B and mount a blanking bar in the grooves 24A and 24B which accommodated the blades.

The invention is directed to simplifying the operations for changing from one configuration to the other on a machine of this kind.

To this end it proposes that the machine be provided with a folding cylinder comprising at least one insertion blade movable between two fixed positions, a deployed position in which it projects relative to the lateral surface of the cylinder and is adapted to cooperate with a jaw of the second fold cylinder and a retracted position in which it is inside the folding cylinder, said insertion blade being adapted to be deployed when it is necessary to make said second fold and retracted otherwise.

The invention thus makes it possible to eliminate the operation of mounting or demounting insertion blades and the operation of mounting or demounting blanking bars.

It therefore simplifies considerably the task of the operator responsible for changing from one configuration to the other and significantly reduces the time needed for this maneuver.

According to one preferred characteristic of the invention the folding cylinder comprises two abutment members delimiting the travel of the insertion blade respectively corresponding to the deployed position and to the retracted position.

The operator thus has only to move the relevant member from one abutment member to the other, without needing to check whether the blade has been deployed or retracted correctly.

According to another preferred characteristic of the invention the blade is coupled to a mechanism including a spring member and allowing between said abutment members a configuration in which said spring member is compressed to the maximum and to either side of which the spring member urges the mechanism in a stable manner towards one of said abutment members.

It is therefore sufficient to go past the point of maximum compression for the blade to move automatically to the position opposite that from which it started out. If the spring member is sufficiently strong it can hold the blade in position. Otherwise the blade may be immobilized by clamping it.

In versions of the invention with no spring member mechanism fixing by clamping is preferred as it is particularly secure.

In the usual case where the folding cylinder comprises more than one insertion blade, and in particular two diametrically opposed blades as in the foregoing example, it is particularly advantageous to provide a device for coupling the blades so that they move simultaneously from the deployed position to the retracted position and vice versa.

This further increases the timesaving resulting from use of the invention, as the position of all blades can be changed in a single operation.

Figure 4:
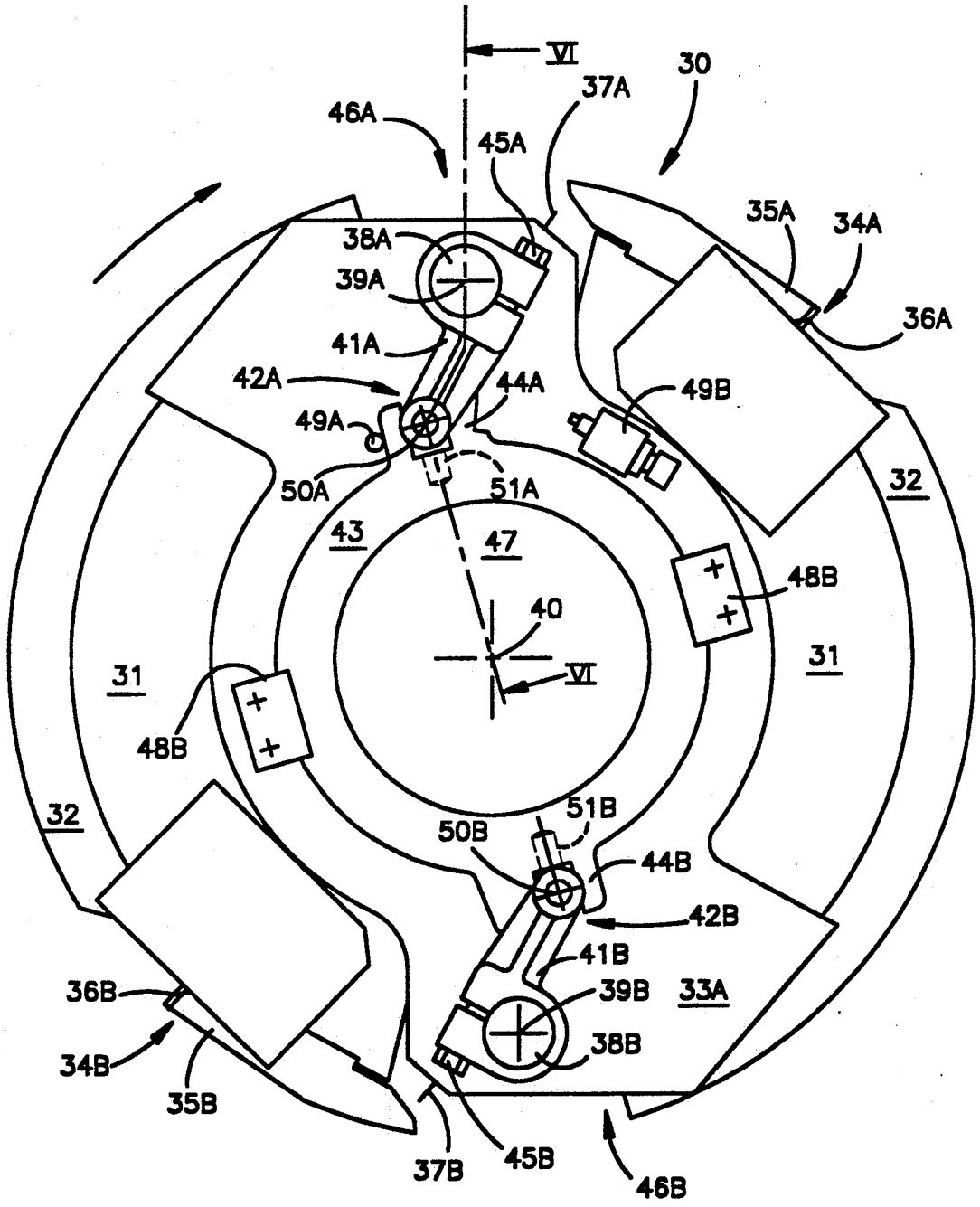
Figure 5:
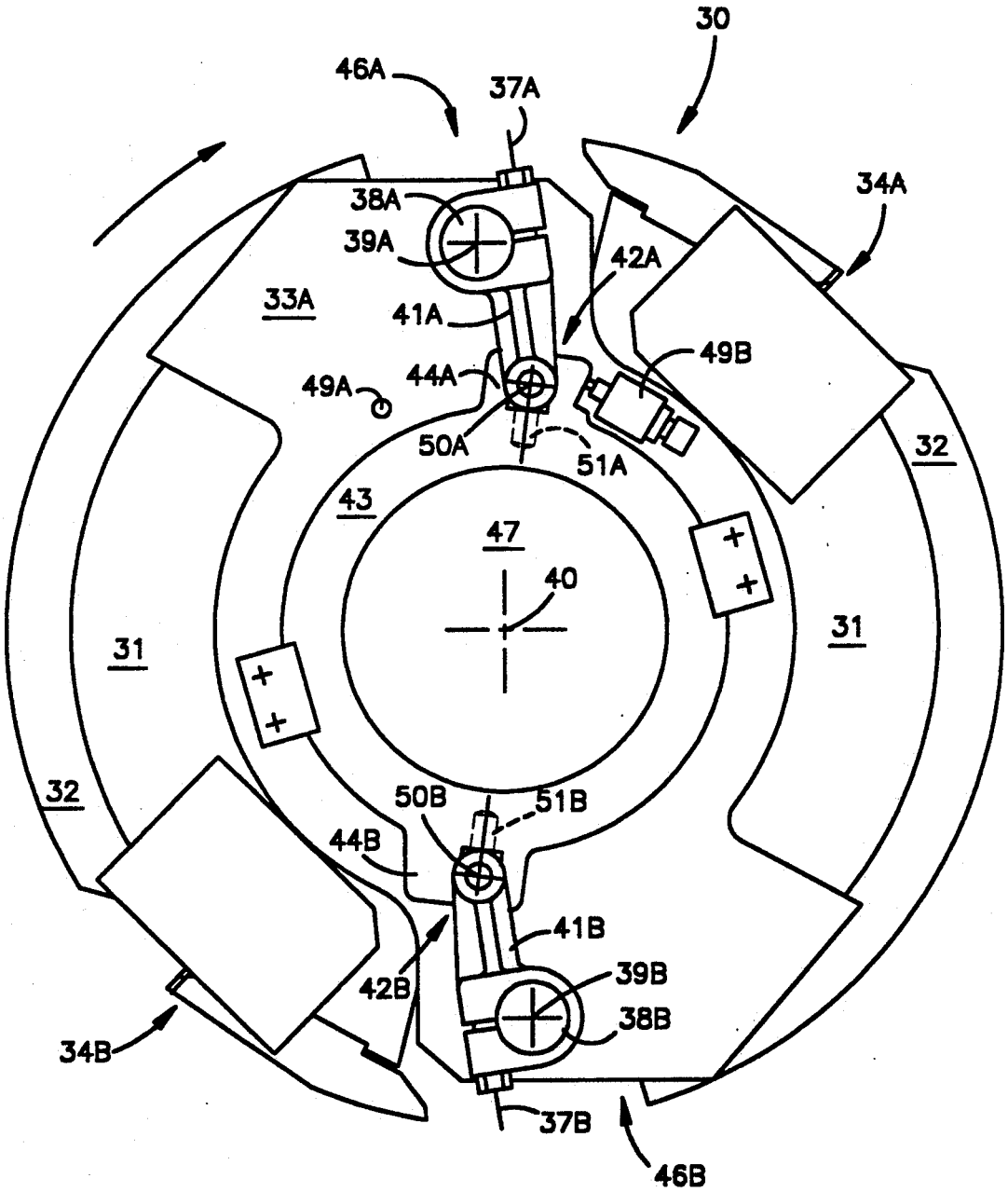
Figure 6:
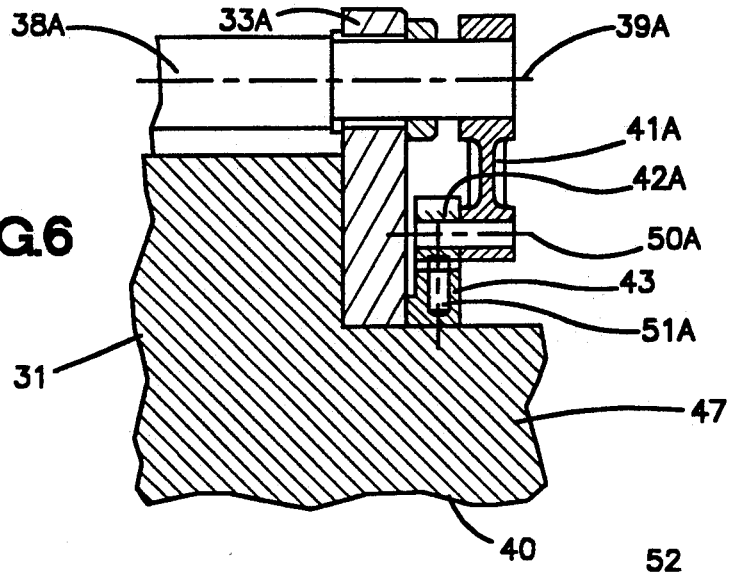
Figure 7:
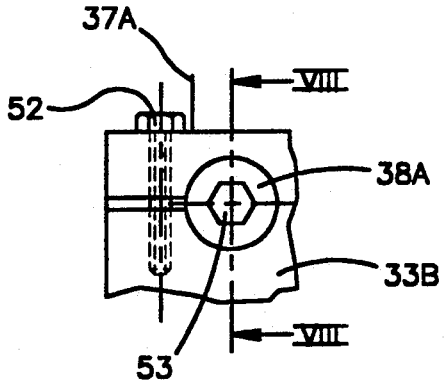
Figure 8:
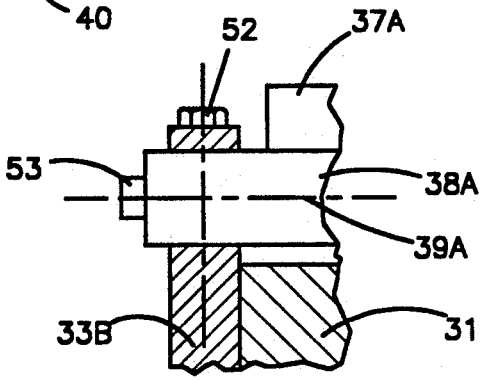
Figure 9:
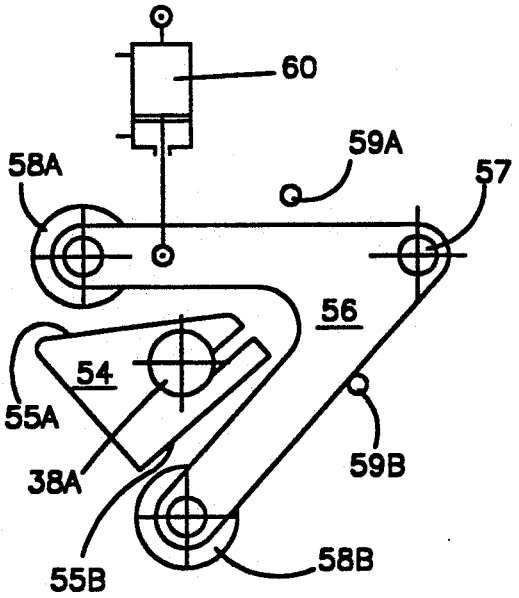
Figure 10:
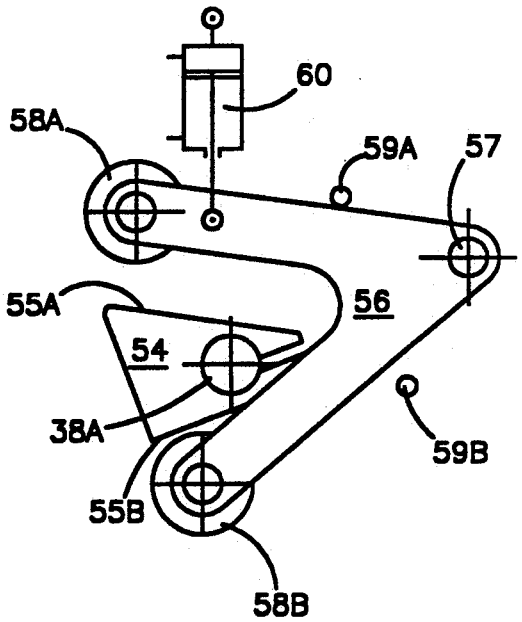

The characteristics, specific features and advantages of the invention will emerge from the following description given by way of illustrative and non-limiting example only with reference to FIGS. 4 through 10 of the appended drawing:

FIG. 4 is a schematic side view in elevation of a folding cylinder in accordance with the invention showing the insertion blades in the retracted position;

FIG. 5 is a view similar to FIG. 4 with the insertion blades in the deployed position;

FIG. 6 is a partial view in half-section on the line VI—VI in FIG. 4;

FIG. 7 is a partial view in elevation of the end of the cylinder opposite that shown in FIGS. 4 and 5;

FIG. 8 is a partial view in cross-section on the line VIII—VIII in FIG. 7; and FIGS. 9 and 10 show a mechanism for moving the blades automatically from the retracted position to the deployed position and vice versa.

Figure 1:
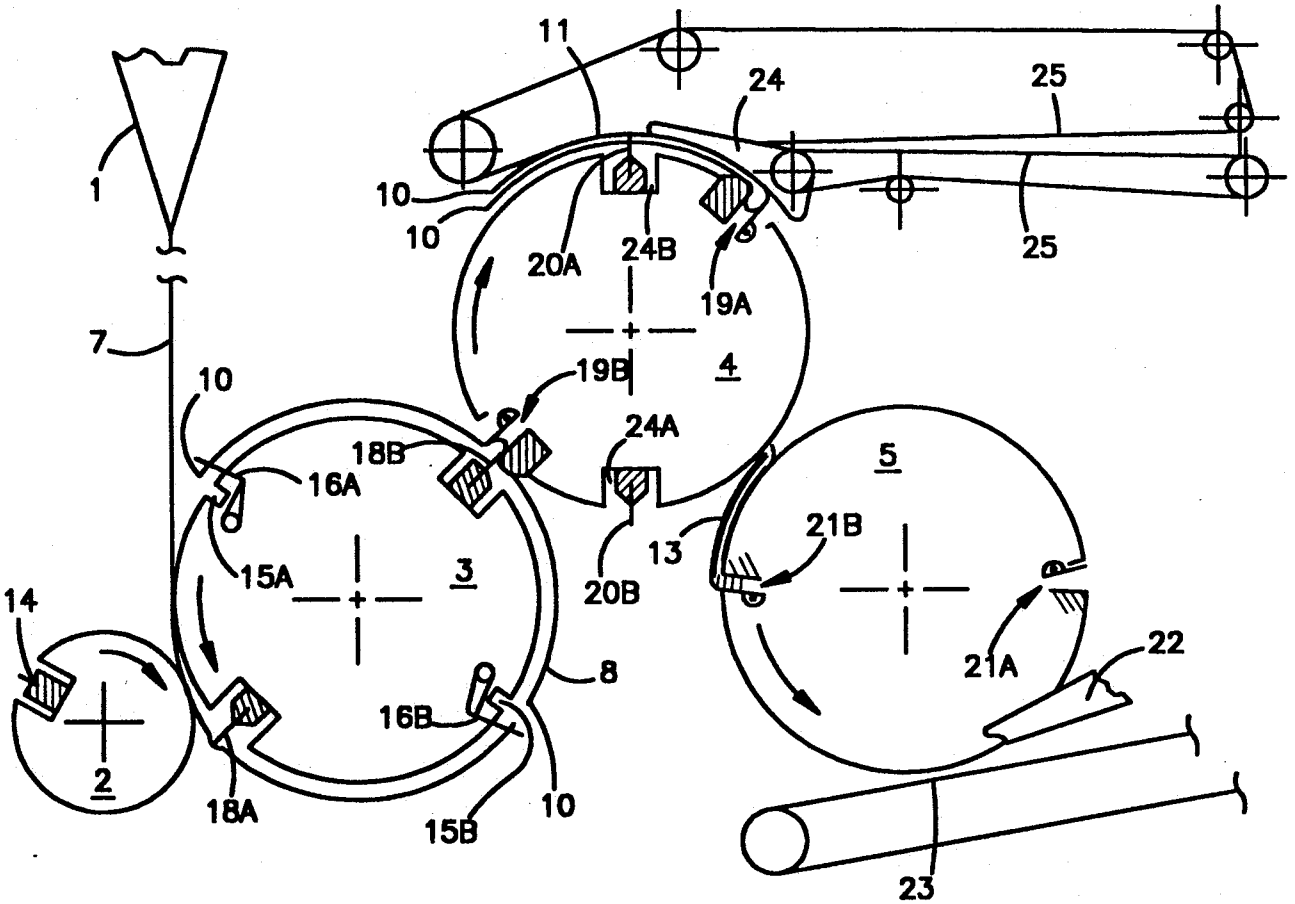
FIG.1 (PRIOR ART)
FIG. 1 is a schematic partial elevation view of the machine.

The folding cylinder 30 is designed to replace the cylinder 4 shown in FIG. 1. It comprises a central portion 31, shown as of unitary construction in order to simplify the drawings, a cylindrical plate 32 which covers the central portion laterally, and flanges 33A and 33B attached to the central portion at respective ends of the cylinder 30.

It is provided with two diametrically opposed first fold jaws 34A and 34B similar to the jaws 19A and 19B of the cylinder 4 from FIG. 1, each comprising a fixed jaw 35A or 35B and a mobile blade 36A or 36B, and with two diametrically opposed insertion blades 37A and 37B approximately one eighth-turn downstream of the respective jaws 34A and 34B.

In accordance with the invention, these insertion blades are mobile between two fixed positions, the deployed position shown in FIG. 5 in which they project relative to the lateral surface of the cylinder—to be more precise relative to the plate 32—and in which they are respectively adapted to cooperate with a jaw such as the jaw 21A or the jaw 21B of the second fold cylinder 5, and the retracted position shown in FIG. 4 in which they are inside the cylinder 30.

When the blades 37A and 37B are in the deployed position (FIG. 5) the cylinder 30 is used in the same way as the cylinder 4 in the configuration shown in FIG. 1 and when the blades are retracted (FIG. 4) it is used in the same way as the cylinder 4 when the blades 20A and 20B have been replaced by blanking bars.

A device is provided for coupling the blades 37A and 37B so that they move simultaneously from the deployed position to the retracted position and vice versa. It comprises, for each insertion blade, a shaft 38A or 38B articulated to the cylinder about an axis 39A or 39B parallel to the rotation axis 40 of the cylinder, on which shaft the blade is mounted so that it is moved between the deployed and retracted positions by rotating the shaft; for each shaft, a lever 41A or 41B carrying at a first end a roller 42A or 42B respectively articulated about an axis 50A or 50B and attached to the shaft at a second end; and a flange 43 articulated to the cylinder about the same rotation axis 40 and comprising for each lever a yoke 44A or 44B oriented in the radial direction and into which the lever roller is slidably inserted.

The levers 41A and 41B are clamped to their respective shafts by the screw 45A or 45B and the shafts 8A and 38B are respectively disposed in a groove 46A or 6B in the cylinder adapted to accommodate the blade in the retracted position and articulated at each end to the flanges 33A and 33B (see FIGS. 6 through 8 in the case of the shaft 38A).

The flange 43 rotates freely about the journal 47 of the cylinder whereas in the lateral direction it is held between the flange 33A and two lugs 48A and 48B screwed to the latter.

Sliding of the roller 42A or 42B in the yoke 44A or 44B enables simultaneous rotation of the flange 43 and of the shafts 38A and 38B by accommodating the variation in distance occurring during such rotation between the end of the lever 41A or 41B and the axis 40 about which the flange rotates.

Two abutment members 49A and 49B respectively corresponding to the retracted position and to the deployed position are provided on the cylinder to facilitate the work of the operator who simply moves the relevant member from one abutment member to the other to move the blades from one position to the other.

The abutment member 49B which corresponds to the deployed position is adjustable which has the advantage of enabling the deployed blade position to be adjusted if necessary.

Between the abutment members 49A and 49B, the coupling device allows a configuration in which the parallel articulation axes 39A, 50A and 40 or 39B, 50B and 40 are coplanar, that is to say a configuration in which the roller 42A or 42B is as close as possible to the flange 43.

A cylindrical recess is provided at the back of each yoke and a spring 51A or 51B placed in it to urge each roller away from the flange.

Each spring is compressed to the maximum in the configuration in which the roller is as close as possible to the flange and to either side of this configuration it urges the flange in a stable manner either towards the abutment member 49A or towards the abutment member 49B.

Thus to move from the deployed position to the retracted position or vice versa the first step is to compress the springs to the point of maximum compression (the same for both the springs) and once this point has been passed the springs automatically move the flange into contact with the abutment member opposite that from which it started out.

Note that it would be sufficient to have a single spring disposed at the back either of the yoke 44A or of the yoke 44B to achieve this effect but that it is beneficial to provide a spring at the back of each yoke to increase the force with which the flange is applied against the abutment member 49A or 49B.

If the springs are strong enough they can hold the blades in the deployed or retracted position; otherwise additional means must be provided, as here: the housing formed in the flange 33B for mounting the shaft 38A is split and comprises a screw 52 for clamping it up and immobilizing the shaft against rotation (see FIGS. 7 and 8).

To move the blades from one fixed position to the other it is possible to operate on the flange 43, on one of the levers 41A or 41B or, as in this case, on one of the shafts 38A or 38B, which are more readily accessible.

In the embodiment shown in FIGS. 7 and 8 the end of the shaft 38A opposite that shown in FIGS. 4 and 5 comprises a prism-shaped (hexagonal) boss 53 adapted to be turned by a wrench.

The size of the boss 53 and that of the head of the screw 52 are advantageously the same so that the same wrench can be used to loosen the housing, turn the shaft 38 and retighten the housing.

In an alternate embodiment shown in FIGS. 9 and 10 there is no need for immobilization by clamping as the springs are sufficiently strong and the operating means on the shaft are no longer a prism-shaped boss but instead a cam 54 with two oppositely directed ramps 55A and 55B fastened to the end of the shaft 38A, and the control member comprises: a V-shape lever 56 articulated at the point to a shaft 57 fastened to the frame of the machine, each end away from the point carrying a respective roller 58A or 58B; two abutment members 59A and 59B between which the lever 56 moves, respectively corresponding to the retracted position (FIG. 10) and to the deployed position (FIG. 9) of the blades, one of the rollers operating during a slow rotation of the cylinder on one of the ramps of the cam to turn the shaft to the required position, if it is not already there, that is to say at least until the point of maximum compression is passed; and control means for the lever 56.

In the position shown in FIG. 9 (blade deployed) the ramp 55A, which was previously in the position shown in FIG. 10, bears on the roller 58A which causes the ramp to tilt to the position shown, in other words the flange 43 to swing from the abutment member 49B over to the abutment member 49A.

On the other hand, in the position shown in figure 10 it is the ramp 55B which bears on the roller 58B, causing the flange 43 to move from the abutment member 49A to the abutment member 49B.

In the embodiment shown the V-shape lever control means comprise a piston-and-cylinder actuator 60 and in an alternative embodiment they comprise a rod.

Note that the control means shown in FIGS. 9 and 10 have the advantage of enabling remote control and automatic movement of the blade from one position to the other.

In further embodiments (not shown) likely to be beneficial according to the machine for which the folding cylinder is intended, the cylinder comprises only a single insertion blade or more than two such blades.

Of course, the invention is not limited to the embodiments described and shown in the figures but encompasses any variant execution thereof that might be envisaged by those skilled in the art.

I claim:

1. Machine for cutting and folding a printed paper strip, comprising a triangle, a cutting cylinder, a transfer cylinder, a folding cylinder and a second fold cylinder in which the strip passes first into the triangle which forms a longitudinal fold midway between its edges and then passes a transverse cut is made to separate a copy from the folded strip, the copy then passing between the transfer and folding cylinders at which a transverse, so-called first fold is made midway between the cuts which delimit the copy, which becomes at the end of such folding a tabloid brochure, which is either stripped directly from the folding cylinder or passed between the folding cylinder and the second fold cylinder at which a transverse, so-called second fold is made midway between the transverse cuts and the first fold; this machine being characterized in that; the folding cylinder (30) comprises at least one insertion blade (37A, 37B) movable between two fixed positions, a deployed position in which it projects relative to the lateral surface of the cylinder and is adapted to cooperate with a jaw of the second fold cylinder and a retracted position in which it is inside the folding cylinder, said insertion blade being adapted to be placed in the deployed position when it is required to make said second fold and in said retracted position otherwise, said folding cylinder (30) comprising two abutment members (49A, 49B) delimiting the travel of the insertion blade (37A, 37B) and respectively corresponding to the deployed position and to the retracted position.

2. Machine according to claim 1 characterized in that said cylinder (30) comprises means for immobilizing the blade by clamping to hold it in the deployed or retracted position.

3. Machine according to claim 1 characterized in that said folding cylinder (30) comprises a plurality of insertion blades (37A, 37B) each movable between said deployed position and said retracted position and a coupling device (38A, 41A, 42A, 43, 42B, 41B, 38B) between said blades for causing them to move simultaneously from the deployed position to the retracted position and vice versa.

4. Machine according to claim 3 characterized in that said coupling device comprises:

for each insertion blade (37A, 37B), a shaft (38A, 38B) articulated to the cylinder about an axis (39A, 39B) parallel to the cylinder rotation axis (40) and on which is mounted said blade, which is movable between said deployed and retracted positions by rotating said shaft;

for each shaft (38A, 38B), a lever (41A, 41B) carrying a roller (42A, 42B) at a first end and fastened to the shaft at a second end; and a flange (43) articulated to the cylinder about the cylinder rotation axis (40) and comprising for each lever (41A, 41B) a yoke (44A, 44B) oriented in the radial direction and into which the lever roller is slidably inserted.

5. Machine according to claim 4 characterized in that the cylinder comprises two abutment members (49A, 49B) delimiting the travel of said flange (43) and respectively corresponding to the deployed position and the retracted position of said blades (37A, 37B).

6. Machine according to claim 5 characterized in that said coupling device allows between said abutment members a configuration in which the roller (42A, 42B) of a lever is as close as possible to the flange (43) and comprises a spring (51A, 51B) between the flange and said roller.

7. Machine according to claim 4 characterized in that at least one of said shafts (38A) is mounted in a split housing comprising a screw (52) for clamping up the housing to immobilize the shaft against rotation.

8. Machine according to of claim 4 characterized in that at least one of said shafts (38A) comprises operating means (53, 54) for coupling a control member adapted to cause it to rotate to move the blade from the deployed position to the retracted position or vice versa.

9. Machine according to claim 8 characterized in that said operating means is a prism-shape boss (53) at the end of the shaft, said control member being a wrench.

10. Machine according to claim 8 characterized in that said operating means is a cam (54) with two oppositely directed ramps (55A, 55B) fastened to the end of the shaft, said control member comprising: a V-shape lever (56) articulated at the point to a shaft fastened to the frame while each end away from the point carries a roller (58A, 58B), two abutment members (59A, 59B)

between which the lever (56) is movable and respectively corresponding to said retracted position and to said deployed position, one of the roller operating during rotation of the cylinder on one of the ramps of the cam to cause the shaft to rotate to the required position if it is not already there, and lever control means.

11. Machine according to claim 10 characterized in that said lever control means comprises a piston-and-cylinder actuator (60).

12. Machine according to claim 11 characterized in that said lever control means comprises a rod.

13. Machine according to claim 1 characterized in that the abutment member (49B) corresponding to the deployed position 14 adjustable.

14. Machine for cutting and folding a printed paper strip, comprising a triangle, a cutting cylinder, a transfer cylinder, a folding cylinder and a second fold cylinder in which the strip passes first into the triangle which forms a longitudinal fold midway between its edges and then passes between the cutting cylinder and the transfer cylinder at which a transverse cut is made to separate a copy from the folded strip, the copy then passing between the transfer and folding cylinders at which a transverse, so-called first fold is made midway between the cuts which delimit the copy, which becomes at the end of such folding a tabloid brochure, which is either stripped directly from the folding cylinder or passed between the folding cylinder and the second fold cylinder at which a transverse, so-called second fold is made midway between the transverse cuts and the first fold; this machine being characterized in that the folding cylinder (30) comprises at least one insertion blade (37A, 37B) movable between two fixed positions wherein the insertion blade remains throughout a complete rotation of the folding cylinder about its axis, a deployed position in which it projects relative to the lateral surface of the cylinder and is adapted to cooperate with a jaw of the second fold cylinder and a retracted position in which it is inside the folding cylinder, said insertion blade being adapted to be placed in the deployed position when it is required to make said second fold and in said retracted position otherwise.

15. Machine according to claim 14 characterized in that said folding cylinder (30) comprises two abutment members (49A, 49B) delimiting the travel of the insertion blade (37A, 37B) and respectively corresponding to the deployed position and to the retracted position.

16. Machine according to claim 15 characterized in that the blade (37A, 37B) is coupled to a mechanism comprising a spring member (51A, 51B) and allowing between said abutment members (49A, 49B) a configuration in which said spring member is compressed to the maximum and on either side of which the spring mechanism urges the mechanism in a stable manner towards one of said abutment members.

17. Machine according to claim 14 characterized in that said cylinder (30 comprises means for immobilizing the blade by clamping to hold it in the deployed or retracted position.

18. Machine according to claim 14 characterized in that said folding cylinder (30) comprises a plurality of insertion blades (37A, 37B) each movable between said deployed position and said retracted position and a coupling device (38A, 41A, 42A, 43, 42B, 41B, 38B) between said blades for causing them to move simultaneously from the deployed position to the retracted position and vice versa.

19. Machine according to claim 18 characterized in that said coupling device comprises:

for each insertion blade (37A, 37B), a shaft (38A, 38B) articulated to the cylinder about an axis (39A, 39B) parallel to the cylinder rotation axis (40) and on which is mounted said blade, which is movable between said deployed and retracted positions by rotating said shaft;

for each shaft (38A, 38B), a lever (41A, 41B) carrying a roller (42A, 42B) at a first end and fastened to the shaft at a second end; and a flange (43) articulated to the cylinder about the cylinder rotation axis (40) and comprising for each lever (41A, 41B) a yoke (44A, 44B) oriented in the radial direction and into which the lever roller is slidably inserted.

20. Machine according to claim 19 characterized in that the cylinder comprises two abutment members (49A, 49B) delimiting the travel of said flange (43) and respectively corresponding to the deployed position and the retracted position of said blades (37A, 37B).

21. Machine according to claim 20 characterized in that said coupling device allows between said abutment members a configuration in which the roller (42A, 42B) of a lever is as close as possible to the flange (43) and comprises a spring (51A, 51B) between the flange and said roller.

22. Machine according to claim 19 characterized in that at least one of said shafts (38A) is mounted in a split housing comprising a screw (52) for clamping up the housing to immobilize the shaft against rotation.

23. Machine according to claim 19 characterized in that at least one of said shafts (38A) comprises operating means (53, 54) for coupling a control member adapted to cause it to rotate to move the blade from the deployed position to the retracted position or vice versa.

24. Machine according to claim 23 characterized in that said operating means is a prism-shape boss (53) at the end of the shaft, said control member being a wrench.

25. Machine according to claim 23 characterized in that said operating means is a cam (54) with two oppositely directed ramps (55A, 55B) fastened to the end of the shaft, said control member comprising: a V-shape lever (56) articulated at the point to a shaft fastened to the frame while each end away from the point carries a roller (58A, 58B), two abutment members (59A, 59B) between which the lever (56) is movable and respectively corresponding to said retracted position and to said deployed position, one of the rollers operating during rotation of the cylinder on one of the ramps of the cam to cause the shaft to rotate to the required piston if it is not already there, and lever control means.

26. Machine according to claim 25 characterized in that said lever control means comprise a piston-and-cylinder actuator (60).

27. Machine according to claim 25 characterized in that said lever control means comprise a rod.

28. Machine according to claim 14 characterized in that said cylinder comprises two diametrically opposed insertion blades (37A, 37B).

* * * * *

UNITED STATES PATENT AND TRADEMARK OFFICE

CERTIFICATE OF CORRECTION

PATENT NO. : 5,078,374

DATED : January 7, 1992

INVENTOR(S) : Michel Odeau

It is certified that error appears in the above-indentified patent and that said Letters Patent is hereby corrected as shown below:

Column 5, line 55, Claim 1, after "passes" insert --between the cutting cylinder and the transfer cylinder at which--.

Column 7, line 14, Claim 13, delete "14" insert --is--.

Column 7, line 57, Claim 17, after "(30" insert --)--.

Column 8, line 56, Claim 25, change "piston" to --position--.

Column 8, line 63, Claim 28, change "diametrically" to --diametrally--.

Signed and Sealed this

Seventh Day of September, 1993

Bruce Lehman

*Attest:*

BRUCE LEHMAN

*Attesting Officer*

*Commissioner of Patents and Trademarks*